US006254728B1

(12) United States Patent
Henssler et al.

(10) Patent No.: US 6,254,728 B1
(45) Date of Patent: Jul. 3, 2001

(54) METHOD AND MACHINE FOR MANUFACTURING A FIBROUS PULP WEB

(75) Inventors: Joachim Henssler, Ravensburg; Hans Loser, Langenau; Karl Steiner, Herbrechtingen; Albrecht Bauder, Königsbronn, all of (DE)

(73) Assignee: Loith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 09/012,731

(22) Filed: Jan. 23, 1998

(30) Foreign Application Priority Data

Jan. 24, 1997 (DE) ..... 197025757

(51) Int. Cl.[7] ..... D21F 11/00; D21F 11/04; D21F 11/08

(52) U.S. Cl. ..... 162/205; 162/204; 162/203

(58) Field of Search ..... 162/300, 301, 162/351, 358.3, 358.5, 360.2, 360.3, 203, 204, 205

(56) References Cited

U.S. PATENT DOCUMENTS 4,623,429 11/1986 Tissari .
4,714,521 12/1987 Fujiwara .
4,976,821 * 12/1990 Laapotti ..... 162/360.1
5,611,893 * 3/1997 Pajula et al. ..... 162/360.2
5,639,351 * 6/1997 Ilmarinen ..... 162/205
5,762,761 * 6/1998 Kivimaa et al. ..... 162/360.2
5,830,323 * 11/1998 Grimm ..... 162/360.2
5,908,536 * 6/1999 Kaasalainen et al. ..... 162/205

FOREIGN PATENT DOCUMENTS 3217860 12/1982 (DE) .
9113500 2/1992 (DE) .

* cited by examiner

*Primary Examiner*—Stanley S. Silverman
*Assistant Examiner*—Dionne A. Walls
(74) *Attorney, Agent, or Firm*—Greenblum & Bernstein, P.L.C.

(57) ABSTRACT

A method and machine for the manufacturing a fibrous pulp web including a first draining zone and a second draining zone, where the first and second draining zones are successively arranged in the web run direction, where a first side of the web is drained in the first draining zone by pressure acting on the web which increases from an initial pressure to a final pressure, where a second side of the web is drained in the second draining zone by pressure acting on the web which increases from an initial pressure to a final pressure in the web run direction, and where the initial pressure in the second draining zone is less than the final pressure in the first draining zone.

3 Claims, 3 Drawing Sheets

METHOD AND MACHINE FOR MANUFACTURING A FIBROUS PULP WEB

CROSS-REFERENCE TO RELATED APPLICATION

The present invention claims the priority under 35 U.S.C. §119 of German Application No. 197 02 575.7 filed Jan. 24, 1997, the disclosure of which is expressly incorporated by reference herein in its entirety.

BACKGROUND INFORMATION

1. Field of the Invention

The invention relates to a machine for manufacturing a fibrous pulp web, in particular for a paper or cardboard web.

2. Discussion of Background Information

At higher drainage rates, the formation of a thickened boundary layer on the surface of a web may occur, and it may prevent water from further penetrating the web's surface. In the screen section or press section of the paper machine, for example, this not only may cause undesirable effects, such as slight re-moistening of the web, but it also may crush the web. The same relationship essentially exists for the screen and press sections of a web manufacturing machine.

SUMMARY OF THE INVENTION

The present invention provides a machine for manufacturing a fibrous pulp web which, in particular, is optimized to achieve the highest possible level of dry content, as well as the most gentle handling of the web. According to the invention, the web manufacturing machine includes at least two sequentially positioned draining zones, where the sides of the fibrous pulp web are drained due to a pressure imparted on the web which increases from an initial pressure to a final pressure in the web run direction, where one side of the fibrous pulp web is drained in the first draining zone, where the second side of the fibrous pulp web is drained in the second draining zone, and where the initial pressure in the second draining zone is lower than the final pressure in the first draining zone.

In web run direction before the first and second draining zones, each of which causes one side of the web to be drained, a further draining zone can be provided, where the fibrous pulp web can be drained simultaneously on both sides. In this further draining zone, the web is drained preferably between two screen belts (or sieve belts), between two felt belts and/or between one screen belt (or sieve belt) and one felt belt.

It is advantageous if the pressure acting on the fibrous pulp web in at least one draining zones is created by stretching the web with at least one screen belt and/or felt belt. To increase the stretching of the web, several screen/sieve or felt belts can be provided.

According to another aspect of the invention, a pressure-inducing screen belt and/or felt belt is guided over a roll with a stiff sleeve, or a shoe press device, which may be grooved or sectioned.

A screen belt (sieve belt) is preferably guided over a suction apparatus.

According to another aspect of the invention, drainage of the web occurs in at least one draining zone due to applied differential pressure.

The increase in pressure in the second draining zone is for practical purposes somewhat greater than or equal to the increase in pressure in the first draining zone. Fundamentally, it is also possible to selectively compress the surface of the web with a high final pressure.

The fibrous pulp web is preferably guided through at least one press opening of a mechanical press in at least one draining zone. It is advantageous if at least one press opening is formed by a shoe press elongated in the web run direction.

According to still another aspect of the invention, at least one single-felted press opening is provided, and it is advantageous if the fibrous pulp web is guided through this press opening between the felt and smooth surface which is created, in particular, by a roll, a sleeve of a shoe press device, and/or a belt.

The final pressure in the further draining zone that which is arranged before the first draining zone in web run direction is preferably lower than or equal to the initial pressure in the first draining zone.

According to another aspect of the invention, the initial pressure in the first or second draining zone causing single-sided draining is essentially at least as great as the final pressure in the preceding draining zone which effects single-sided draining on the same side of the web.

The final pressure in the last draining zone causing single-sided draining from one side of the web is at least essentially equal to the final pressure in the last draining zone causing single-sided draining from the other side of the web.

For the production of a multi-layered fibrous pulp web, a machine according to the invention may include a multi-level head box. It thus becomes possible to utilize different types of materials.

The material for making fibrous web sheets may or may not contain hydrogen peroxide. In particular, with hydrogen-peroxide-free paper, thickening of the surface occurs frequently in the press opening, which hinders water from draining out of the web in subsequent press openings. This disadvantage is avoided in accordance with the invention because the linear pressure in the press opening of the first shoe press, as seen in web run direction, may be less than or equal to 15 bar. The maximum pressure lies in the vicinity of approximately 2 bar to approximately 15 bar, and for practical use from approximately 2 bar to 8 bar, where 8 bar is preferred.

According to another aspect of the invention, the linear force produced by the press opening of the first shoe press is less than about 300 kN/m, and preferably is less than or equal to about 150 kN/m.

It is advantageous if the length of the press shoe assigned to the first shoe press, as seen in web run direction, lies within the range of approximately 200 mm to approximately 350 mm.

The mating roll assigned to the press shoe unit of the first press shoe can be a suction roll. This roll can be additionally equipped with blind holes and/or can be grooved. In place of a suction roll, however, a simple roll with dry holes may be provided. The mating roll, however, may also be a grooved roll.

According to another aspect of the invention, a second shoe press is provided behind the first shoe press in the web run direction, such that the linear pressure in the press opening of this second shoe press is approximately three times as great as that in the press opening of the first shoe press. Preferably, the pressure lies in the vicinity of approximately 15 bar to approximately 30 bar. It is preferred if the linear force produced in the press opening of the second shoe press is about approximately 450 kN/m.

A roll press with a press opening located between two stiff roll sleeves can be provided behind the first shoe press, such that the maximum pressure in this press opening lies in the vicinity of approximately 8 bar to approximately 20 bar, particularly from 8 bar to 15 bar, and preferably amounts to approximately 10 bar.

The linear force produced during processing in the press opening of the roll press preferably lies in the vicinity of approximately 10 kN/m to approximately 30 kN/m, preferably approximately 20 kN/m.

A further shoe press can be provided in web run direction behind the first shoe press and, respectively, behind the second shoe press and the roll press, such that the maximum linear force produced in the elongated press opening of the further shoe press lies in the vicinity of approximately 600 kN/m to 1200 kN/m and, optimally, can run to approximately 800 kN/m.

An additional press also can be provided behind the further shoe press in the web run direction. According to another aspect of the invention, the openings of the other shoe press and of the additional press can be felted on different sides of the web. The maximum pressure of the press opening in the additional press can be about equal to that of the press opening of the further shoe press. The additional press can, for example, be a shoe press or also a simple roll press.

The press opening of the first shoe press is preferably double-felted.

According to another aspect of the invention, the paper making machine includes at least one shoe press with a press opening elongated in web run direction, in which the linear force is less than approximately 150 kN/m, preferably less than approximately 100 kN/m. Such a shoe press can thus be used as a substitute for a roll press. It is thereby possible to manufacture shoe press units with smaller diameters of, for example, 600 mm, which can be easily installed into current press machines. Such a shoe press device may be used to improve the quality of machines, for making cardboard, as well as for making graphic papers and for other qualities.

The present invention provides a method for manufacturing a fibrous pulp web that includes forming a first draining zone and a second draining zone, arranging the first and the second draining zones successively in a web run direction, applying pressure which increases from an initial pressure to a final pressure in the web run direction to drain a first side of the web in the first draining zone, and applying pressure which increases from an initial pressure to a final pressure in the web run direction to drain a second side of the web in the second draining zone, where the initial pressure in the second draining zone is less than the final pressure in the first draining zone. The method also may include forming a further draining zone before the first draining zone in the web run direction, and applying pressure which increases from an initial pressure to a final pressure in the web run direction to simultaneously drain the first and the second sides of the web in the further draining zone. The simultaneous draining of the first and the second sides of the web can take place between two screen belts, two felt belts, and/or a screen belt and a fan belt.

The method may include applying pressure by stretching the web with a screen belt and/or a felt belt. Additionally, the method may include guiding a screen belt and/or a felt belt over a roll with a stiff roll sleeve. Suction may be applied to the roll, and the roll may be grooved. Further, the method may include a screen belt and/or a felt belt over a shoe press unit. Suction may be applied to the shoe press unit. The method of the present invention may include providing a screen belt and a suction apparatus, and guiding the screen belt over the suction apparatus.

The web may be drained with an applied differential pressure in first draining zone and/or the second draining zone. This differential pressure may be within the range of approximately 0.2 bar to approximately 0.9 bar. Moreover, the maximum differential pressure may be within the range of approximately 0.7 bar to approximately 0.95 bar. Further, the pressure increase in the second draining zone may be greater than or equal to the pressure increase in the first draining zone.

According to the present invention, the web may be guided through a press opening of a mechanical press in the first draining zone and/or in the second draining zone. This mechanical press may be a shoe press, with its press opening being elongated in the web run direction. This press opening may include a single felt belt. Further, the web may be guided through the press opening between the felt belt and a smooth surface. This smooth surface may include the surface of a roll, a sleeve of a shoe press unit and/or a belt.

The final pressure in the further draining zone may be less than or equal to the initial pressure in the first draining zone. Moreover, the present invention may include forming a third draining zone and a fourth draining zone, arranging the third and the fourth draining zones successively in the web run direction, applying pressure which increases from an initial pressure to a final pressure in the web run direction to drain a first side of the web in the third draining zone, and applying pressure which increases from an initial pressure to a final pressure in the web run direction to drain a second side of the web in the fourth draining zone, where the initial pressure in the third draining zone is equal to or greater than the final pressure in the first draining zone. Moreover, according to the invention, the final pressure in the fourth draining zone may be equal to or greater than the final pressure in the first draining zone.

According to another aspect of the invention, the present invention may include forming a third draining zone and a fourth draining zone, arranging the third and the fourth draining zones successively in the web run direction, applying pressure which increases from an initial pressure to a final pressure in the web run direction to drain a first side of the web in the third draining zone, and applying pressure which increases from an initial pressure to a final pressure in the web run direction to drain a second side of the web in the fourth draining zone, where the initial pressure in the fourth draining zone is equal to or greater than the final pressure in the second draining zone. Moreover, the final pressure in the fourth draining zone may be equal to or greater than the final pressure in the first draining zone. The present invention may include creating a multi-layered web with a multi-layer head box.

The present invention provides a method for manufacturing a fibrous pulp web that includes providing a first shoe press, forming a press opening which is elongated in a web run direction in the first shoe press, guiding the web through the press opening of the first shoe press, and applying pressure to the web in the press opening of the first shoe press, where a maximum pressure in the press opening of the first shoe press is less than or equal to approximately 15 bar, and where the web is a paper web and/or a cardboard web. The maximum pressure in the press opening of the first shoe press may be within the range of approximately 2 bar to approximately 15 bar. Alternatively, the maximum pressure in the press opening of the first shoe press lies may be within the range of approximately 2 bar to approximately 8 bar, and preferably may be approximately 8 bar.

The present invention may include creating a linear force during machine operation in the press opening of the first shoe press, where the linear force is less than approximately 300 kN/m. Moreover, this linear force may be less than approximately 150 kN/m. The first shoe press may include a press shoe, and the length of the press shoe in the web run direction may be within the range of approximately 200 mm to approximately 350 mm.

The present invention may include providing a second shoe press, arranging the second shoe press behind the first shoe press in the web run direction, forming a press opening which is elongated in a web run direction in the second shoe press, guiding the web through the press opening of the second shoe press, and applying pressure to the web in the press opening of the second shoe press, where the maximum pressure in the press opening of the second shoe press is approximately three times as large as the maximum pressure in the press opening of the first shoe press. This maximum pressure in the press opening of the second shoe press lies may be within the range of approximately 15 bar to approximately 30 bar. Moreover, the invention may include creating a maximum linear force during machine operation in the press opening of the second shoe press, where the maximum linear force in the press opening of the second shoe press is less than approximately 450 kN/m.

The present invention may include providing a roll press that includes two stiff roll sleeves, arranging the roll press behind the first shoe press in the web run direction, and forming a roll press opening between the two stiff roll sleeves, where a maximum pressure in the roll press opening lies within the range of approximately 8 bar to approximately 20 bar. This maximum pressure may lie within the range of approximately 8 bar to approximately 15 bar, and preferably may be approximately 10 bar. The present invention may creating a linear force during machine operation in the roll press opening, where the linear force in the roll press opening lies within the range of approximately 10 kN/m to approximately 30 kN/m, and preferably may be approximately 20 kN/m.

Another aspect of the present invention includes creating a maximum linear force during machine operation in the press opening of the second shoe press, where the maximum linear force lies within the range of approximately 600 kN/m to approximately 1200 kN/m. This maximum linear force may be approximately 800 kN/m. The invention may include providing an additional press having a press opening which is elongated in the web run direction, arranging the additional press behind the second shoe press in the web run direction, guiding the web through the press opening of the additional press, and providing a felt belt on each side of the web in the press opening of the additional press and in the press opening of the second shoe press, where a maximum pressure in the press opening of the additional press is approximately equal to the maximum pressure in the press opening of the second shoe press. Moreover, according to the present invention, the press opening of the first shoe press may include two felt belts.

The present invention may include forming a shoe press opening, guiding the web through the press opening, and creating a maximum linear force during machine operation in the press opening, where the maximum linear force is less than approximately 150 kN/m. The maximum linear force may be less than approximately 100 kN/m. The shoe press opening may be formed by a shoe press unit whose diameter is approximately 600 mm.

The present invention provides a machine for manufacturing a fibrous pulp web that includes a first shoe press having a press opening which is elongated in a web run direction, wherein the web is a paper and/or cardboard web, where the web is guided through the press opening, where a maximum pressure in the press opening of the first shoe press is less than or equal to approximately 15 bar, and where a linear force created during machine operation in the press opening of the first shoe press is less than approximately 300 kN/m. The first shoe press may include a press shoe, where the length of the press shoe in the web run direction lies within the range of approximately 200 mm to approximately 350 mm.

The present invention may include a second shoe press having a press opening which is elongated in the web run direction, where the second shoe press is arranged behind the first shoe press in the web run direction, where the web is guided through the press opening of the second shoe press, and where a maximum pressure in the press opening of the second shoe press is approximately three times as large as the maximum pressure in the press opening of the first shoe press. This maximum pressure in the press opening of the second shoe press may be within the range of approximately 15 bar to approximately 30 bar. Moreover, a maximum linear force created during machine operation in the press opening of the second shoe press may be less than approximately 450 kN/m.

The machine for manufacturing a fibrous web may include a roll press having two stiff roll sleeves, where the roll press is arranged behind the first shoe press in the web run direction, where the roll press forms a roll press opening between the two stiff roll sleeves, and where a maximum pressure in the roll press opening lies within the range of approximately 8 bar to approximately 20 bar. A linear force created during machine operation in the roll press opening may be within the range of approximately 10 kN/m to approximately 30 kN/m. Moreover, a maximum linear force created during machine operation in the press opening of the second shoe press may be within the range of approximately 600 kN/m to approximately 1200 kN/m.

According to another aspect of the invention, the machine may include an additional press having a press opening which is elongated in the web run direction, and two felt belts with one felt belt of the two felt belts being provided on each side of the web in the press opening of the additional press and in the press opening of the second shoe press, where the additional press is arranged behind the second shoe press in the web run direction, and where a maximum pressure in the press opening of the additional press is approximately equal to the maximum pressure in the press opening of the second shoe press. Moreover, the press opening of the first shoe press may include two felt belts. Further, according to the present invention, at least one shoe press may form a press opening where the maximum linear force created during machine operation in the press opening is less than approximately 150 kN/m. This shoe press unit may have a diameter of approximately 600 mm.

Further, the aforementioned and following characteristic features of the present invention can be used not only in the described combinations, but also in other combinations or alone, without departing from the scope of the invention. Further embodiments and advantages can be seen from the detailed description and the accompanying Figures.

BRIEF DESCRIPTION OF THE DRAWINGS

The present invention is further described in the detailed description which follows, in reference to the noted drawings by way of non-limiting examples of preferred embodiments of the present invention, wherein the same reference numerals represent similar parts throughout the drawings, and wherein.

DETAILED DESCRIPTION OF THE INVENTION

Figure 1:
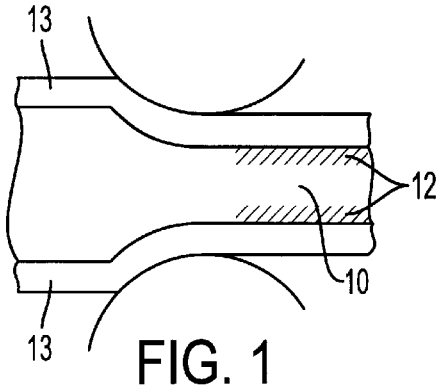
FIG. 1 illustrates a fibrous pulp web which has been guided through a double-felted roll opening.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing making apparent to those skilled in the art how the several forms of the invention may be embodied in practice.

FIG. 1 depicts a web 10 being guided through a roll opening. The roll opening is double-felted, such that web 10 is drained bilaterally by both felts 13. At higher drainage speeds, a thickened boundary layer 12 can develop on the web surface which hinders water from further penetrating the web surface.

Figure 2:
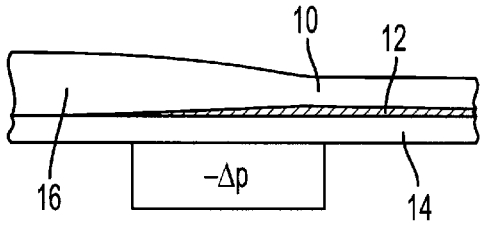
FIG. 2 illustrates a screen belt which supports a fibrous pulp web, on which differential pressure is applied.

In FIG. 2, screen belt 14 supports fibrous pulp web 10, where on one side of screen belt (sieve belt) 14 a material suspension 16 is introduced, and where on the other side of screen belt 14 a differential pressure ($-\Delta p$) is applied. As can be seen from FIG. 2, thickened layer 12 may be formed. The thickening of the web surface depends, among other things, on the composition of the web material, the surface weight of the web sheet, and the dry content of the web.

Figure 8:
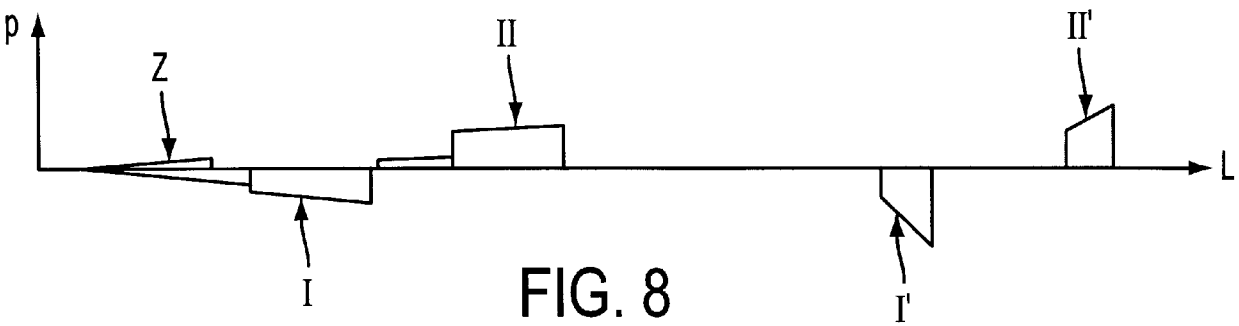
FIG. 8 illustrates the increase in pressure in several draining zones arranged subsequent to one another in web run direction according to the embodiment of the invention depicted in FIG. 7.

To avoid the disadvantages resulting from surface thickening, one aspect of the invention provides a machine for manufacturing a fibrous pulp web, in particular a machine for manufacturing a paper or cardboard web, that includes at least two draining zones I, II (see FIGS. 3, 4 and 8) arranged subsequent to one another in web direction L. Web 10 is drained in web run direction L with a progressively increasing pressure from initial pressure to a final pressure ($p_1$ to $p_2$, or $p_3$ to $p_4$, in FIG. 3), such that draining of web 10 first occurs, as seen in the web run direction, in draining zone I on one side of the web, and draining then occurs in draining zone II on the other side of the web, and where the initial pressure $p_3$ in second draining zone II is lower than the final pressure $p_2$ in first draining zone I. As illustrated in FIG. 8, two additional such draining zones, I', II', are provided.

Figure 3:
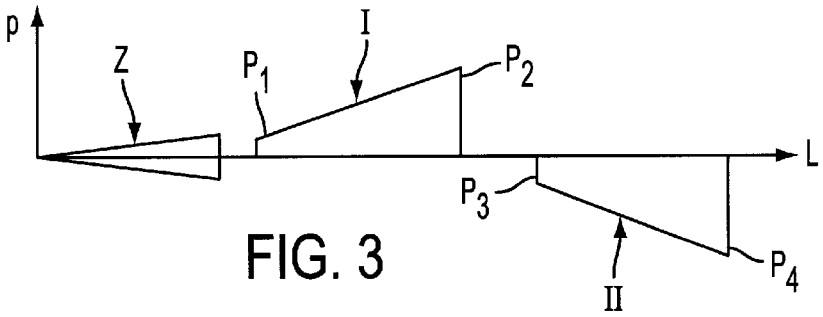
FIG. 3 illustrates the increase in pressure in three draining zones arranged subsequent to one another in the web run direction according to one aspect of the invention.

FIG. 3 illustrates the pressure increase in three draining zones successively arranged in web run direction L according to another embodiment of the invention. According to FIG. 3, another draining zone Z is provided in web run direction L before the first zone I or the second zone II, each of which cause only single-sided draining of the web. In draining zone Z, however, the pulp 10 is dried on both sides of the web.

As can be seen in FIG. 3, initial pressure $p_3$ in second draining zone II is substantially lower than final pressure $p_2$ in first draining zone I. In the example illustrated in FIG. 3, drainage in the first draining zone I occurs upward, while drainage in the second draining zone II occurs downward.

Figure 4:
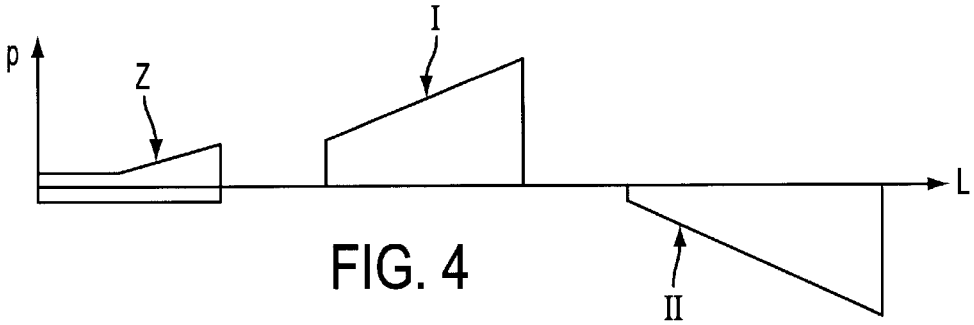
FIG. 4 illustrates the increase in pressure in three draining zones positioned subsequent to one another in web run direction according to another aspect of the invention.

In contrast with FIG. 3, in FIG. 4 drainage in further draining zone Z only occurs upward. Again, initial pressures $p_1$, $p_3$, are less than respective final pressures $p_2$, $p_4$ in the draining zones I, II, causing single-sided drainage.

According to FIG. 3, the increase in pressure is essentially equal in both draining zones I, II. In contrast, in FIG. 4, the pressure increase in second zone II is greater than in first drainage zone I.

FIG. 3 also illustrates that the final pressure in the double-sided draining zone Z is essentially equal to the initial pressure $p_1$ in the first single-sided draining zone I. Alternatively, the final pressure of a previous double-sided draining zone can be marginally lower than the initial pressure of a subsequent single-sided draining zone.

Double-sided drainage of the fibrous pulp web may occur, for example, between two screen belts, two felt belts, and/or between one screen and one felt belt.

Figure 5:
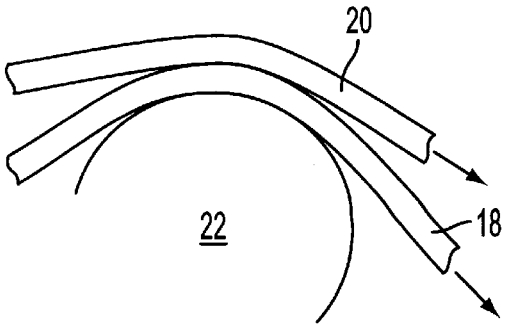
FIG. 5 illustrates two screen or felt belts being guided over a curved surface.

According to FIG. 5, the pressure acting on web 10 is created by the stretch of the web about two belts 18, 20 being guided over a curved surface, each of which may be a screen belt and/or a felt belt. In FIG. 5, belt 18 is guided directly over roll 22 with a stiff roll sleeve. However, it is also possible to guide belt 18, for example, over a shoe press unit. Roll 22, or the shoe press unit, can be grooved or sectioned. Moreover, a screen can be guided over at least one suction apparatus. Further drainage can occur by applying differential pressure, as is illustrated in FIG. 2.

Figure 6:
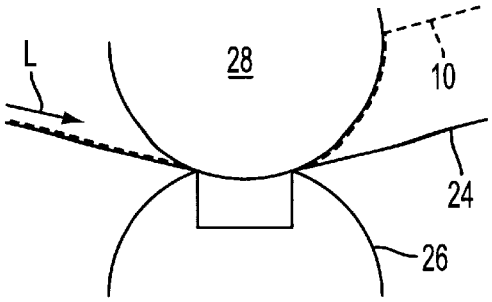
FIG. 6 illustrates a single-felted press opening of a shoe press.

In at least one draining zone, the fibrous pulp web 10 can be guided through a press opening of a mechanical press. Thus, a single-felt opening of a shoe press is depicted in FIG. 6. Fibrous pulp web 10 is guided between felt 24 and a circulating smooth surface through the press opening, which in FIG. 6 is formed by smooth mating roll 28 assigned to shoe press unit 26.

Figure 7:
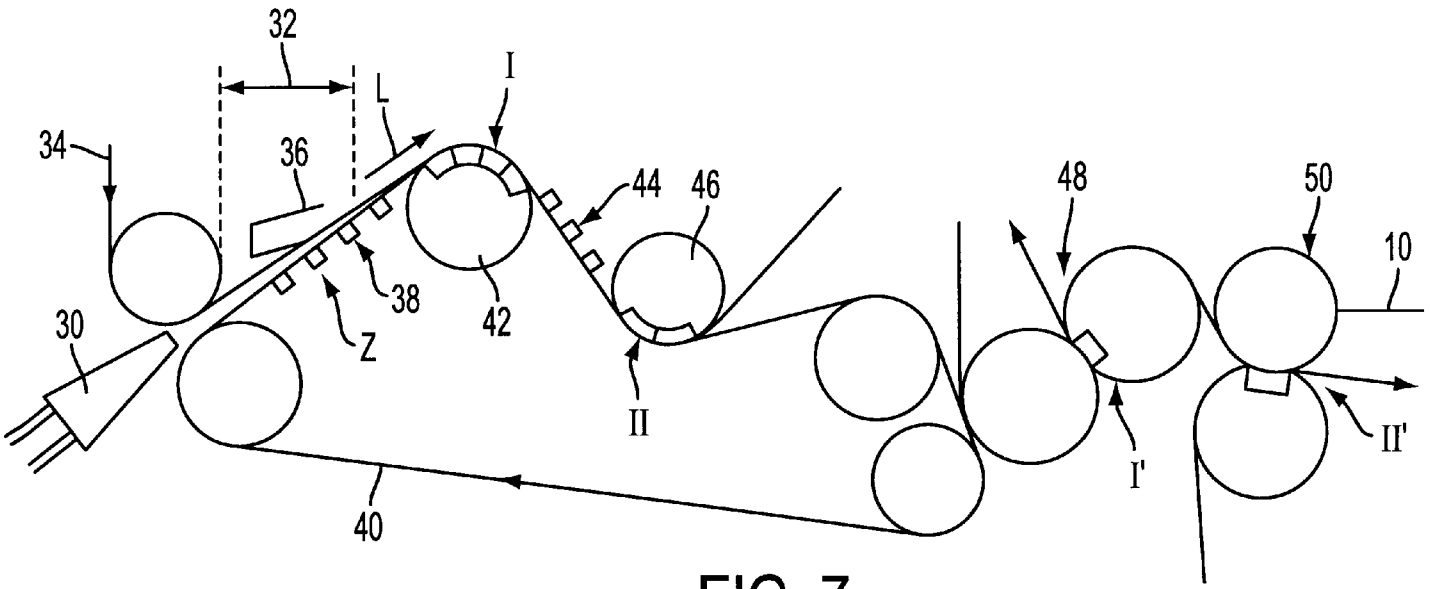
FIG. 7 illustrates a side view of a machine for manufacturing a fibrous pulp web according to another aspect of the invention.

FIG. 7 illustrates another aspect of the present invention. Several draining zones Z, I, II, I' and II' are successively arranged in the web run direction, and their respective pressure increases are illustrated in FIG. 8. Following draining zones I and II in web run direction L, two more single-sided draining zones I' and II' are provided, where drainage again occurs on different sides of the web. Moreover, drainage in draining zone I' takes place in a direction opposite that of the drainage in zone II.

According to FIGS. 7 and 8, the initial pressure in third zone I', where single-sided drainage occurs downward, is essentially as much as the final pressure in first draining zone I, where single-sided drainage was caused on the same side of the web. Additionally, the initial pressure of fourth draining zone II', which causes single-sided upward drainage, is essentially as much as the final pressure in second draining zone II, which causes single-sided drainage on the same sheet side. Further, the final pressure in the last draining zone II', causing single-sided upward drainage, is at least essentially equal to the final pressure in the last draining zone I', causing single-sided downward drainage.

The aspect of the invention depicted in FIG. 7 encompasses a multi-layered head box 30 for the manufacture of a multi-layered fibrous pulp web.

In sheet forming zone 32, wetting media 36, e.g. water, is provided onto the loop of upper screen belt 34. Opposite from this is provided a first suction apparatus 38, which is arranged in the loop of lower screen belt 40. In the vicinity of suction apparatus 38, a relatively low differential pressure $\Delta p$ is created, which can lie within the range of approximately 0.1 bar to approximately 0.5 bar, for example. In the vicinity of suction apparatus 38, a draining zone Z also is created (see also FIG. 8).

Screen belts 40, 34 come in to contact and are guided around suction roll 42, in the vicinity of which a draining zone I causes single-sided drainage to occur in the downward direction. The differential pressure created in this example can be of a relatively high amount, for example, approximately 0.6 bar.

In contrast, a relatively low differential pressure is created in the vicinity of the subsequent suction apparatus 44, which pressure lies within the range of approximately 0.1 bar to approximately 0.5 bar. Suction apparatus 44 causes a single-sided upward drainage, as can be observed in FIG. 8, and the differential pressure imparted on the web is less than in the subsequent, single-sided upward drainage that occurs in the vicinity of suction roll 46, around which both screen belts 34, 40 are guided. In the vicinity of the second suction apparatus 44, as well as suction roll 46, the draining zone II is created (see also FIG. 8), which corresponds to a stepped/tiered pressure increase. After passing suction box 46, screen belts 34, 40 are separated from each other. In the vicinity of suction roll 46, a relatively high differential pressure is created, which, as with suction roll 42, can be approximately 0.6 bar, for example.

Additionally, according to FIG. 7, a press section follows the screen section and is comprised of two shoe presses 48, 50. Two draining zones I' and II', also depicted in FIG. 8, are formed by these two shoe presses.

In certain applications, the surface of the web can be thickened selectively by higher final pressures.

Figure 9:
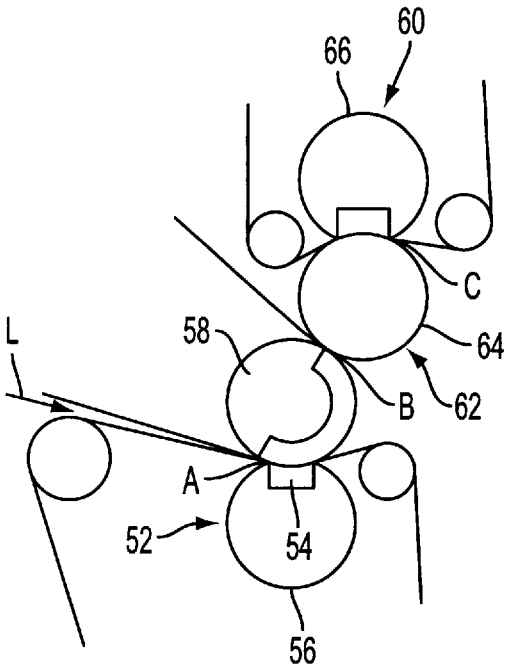
FIG. 9 illustrates a side view of a press arrangement of a machine for manufacturing a fibrous pulp web according to another aspect of the invention.
Figure 10:
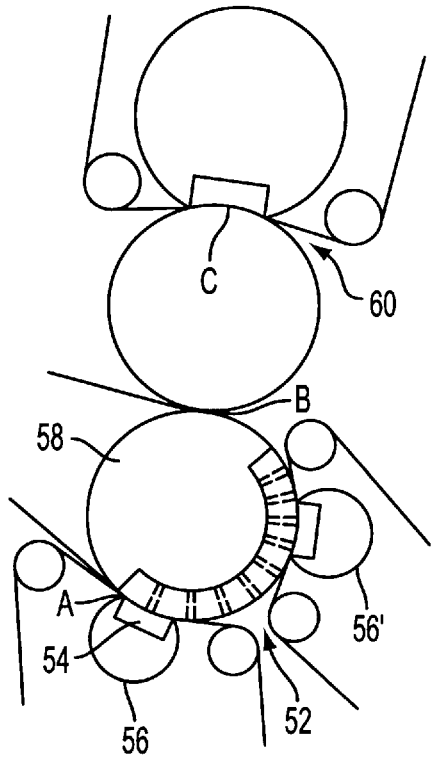
FIG. 10 illustrates a side view of a press arrangement of a machine for manufacturing a fibrous pulp web according to still another aspect of the invention.
Figure 11:
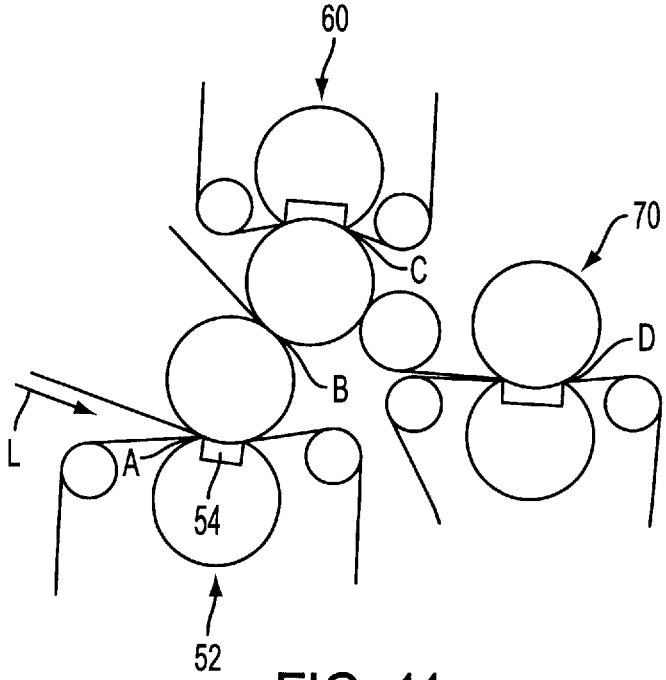
FIG. 11 illustrates a side view of a press arrangement of a machine for manufacturing a fibrous pulp web according to yet another aspect of the invention.

In FIGS. 9–11, press arrangements according to the invention are depicted. Each of these press arrangements includes several shoe presses. The pressure in the press opening of first shoe press 52, as seen in web run direction L, is less than or equal to approximately 15 bar. Further, the maximum pressure lies within the range of approximately 2 bar to approximately 15 bar, more preferably within the range of approximately 2 bar to approximately 8 bar, and preferably amounts to about 8 bar.

Additionally, according to FIGS. 9–11, the linear force created during operation in the press opening of first shoe press 52 is less than about 300 kN/m, and preferably less than or equal to about 150 kN/m. The length of press shoe 54 assigned to shoe press 52, as seen in web run direction L, lies within the range of approximately 200 mm up to approximately 350 mm.

According to FIG. 9, shoe press 52 includes a shoe press unit 56 and a suction roll 58. The press opening A formed by shoe press 52 is double-felted. Also according to FIG. 9, a second shoe press 60 is provided behind the first shoe press 52 in the web run direction, where a roll press 62 is formed between the two shoe presses 52, 60. Roll press 62 includes a roll 64 and a central suction roll 58, and a press opening B is formed therebetween. Roll 64 also serves as the mating roll for shoe press unit 66 assigned to the second shoe press 60, in order to form a third press opening C.

Suction roll 58 can be equipped with dry holes and/or can be grooved, as is shown in FIG. 10. In FIG. 10, an additional shoe press device 56' is assigned to the suction roll 58, in order to form another press opening, which is elongated in web run direction.

Additionally, according to FIG. 10, shoe press device 60 is designed such that pressure is maximized in the press opening C formed by this press, such that this pressure is approximately three times as great as that in the first shoe press. This maximum pressure in press opening C can, for example, lie within the range of approximately 15 bar to approximately 30 bar. Thus, the corresponding linear force can be approximately 450 kN/m.

As shown especially in FIG. 9, roll press 62 that follows first shoe press 52 can be designed such that lower pressure results in press opening B. The maximum pressure in press opening B can lie within the range of approximately 8 bar to approximately 15 bar. The corresponding linear force lies within the range of approximately 10 kN/m to approximately 30 kN/m, and preferably runs to about 20 kN/m.

In addition to the above-noted arrangements, another shoe press can be provided behind the first shoe press, behind the second shoe press, or behind a roll press following a shoe press, such that the linear of force created in the elongated press opening of this additional shoe press lies within the range of approximately 600 kN/m to approximately 1200 kN/m, and preferably will run to approximately 800 kN/m. For example, the shoe press 60 exhibiting the press opening C in the embodiment shown in FIG. 9 can be designed accordingly.

In practice, it may be advantageous if the pressure in press opening A, as illustrated in FIG. 9, is approximately about 8 bar, if the maximum pressure in press opening B lies within the range of approximately 8 bar to approximately 20 bar, and is about 10 bar, and if the pressure in press opening C lies within the range of approximately 30 bar to approximately 100 bar.

The press arrangement of FIG. 11 differs from the arrangement of FIG. 9 primarily in that an additional press 70 (illustrated In FIG. 11 as another shoe press) is provided behind second shoe press 60 in web run direction L. Press openings C, D of second shoe press 60 and additional press 70 are felted on different sides. The maximum pressure in press opening D of additional press 70 preferably is about equal to that of the maximum pressure in press opening C of second shoe press 60.

In FIGS. 9–10, press opening A of the first shoe press 52 is double-felted.

Generally, it is possible to employ at least one shoe press with a linear force that is less than about 150 kN/m, and preferably less than about 100 kN/m, as a replacement for roll presses. Shoe press units with smaller diameters of approximately 600 mm, for example, thus can be manufactured, and they can be easily installed into the present presses. A corresponding shoe press can be utilized for the improvement of machine quality, particularly for the quality of ante-chamber machines, but also for diagrammatic papers and other qualities.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular materials and embodiments, the invention is not intended to be limited to the particulars disclosed herein; rather, the invention extends to a functionally equivalent structures, methods and uses, such as are within the scope of the appended claims.

REFERENCE LIST

10 fibrous pulp web
12 thick layer
13 felt
14 screen belt
16 pulp suspension
18 belt
20 belt
22 roll
24 felt
26 shoe press unit
28 mating roll
30 multi-layer head box
32 sheet-forming zone
34 screen belt
36 water-removal media
38 vacuum
40 screen belt
42 suction roll
44 vacuum
46 suction roll
48 shoe press
50 shoe press
52 shoe press
54 press shoe
56 shoe press unit
56' shoe press unit
58 suction roll
60 second shoe press
62 roll press
64 roll
66 shoe press unit
70 press
A press opening
B press opening
C press opening
I first draining zone
II second draining zone
I' third draining zone
II' fourth draining zone
Z further draining zone

What is claimed is:

1. A method for manufacturing a fibrous pulp web, comprising:

providing a first shoe press and a second shoe press, wherein the second shoe press is arranged behind the first shoe press in a web run direction;

forming a press opening which is elongated in the web run direction in the first shoe press, and forming a press opening which is elongated in the web run direction in the second shoe press;

guiding the web through the press opening of the first shoe press, and through the press opening of the second shoe press;

applying increasing pressure to the web in the press opening of the first shoe press, wherein a maximum pressure in the press opening of the first shoe press is less than or equal to approximately 15 bar;

applying increasing pressure to the web in the press opening of the second shoe press, wherein a maximum pressure in the press opening of the second shoe press is approximately three times as large as the maximum pressure in the press opening of the first shoe press, and wherein an initial pressure in the press opening of the second shoe press is less than a final pressure in the press opening of the first shoe press;

providing an additional press having a press opening which is elongated in the web run direction;

arranging the additional press behind the second shoe press in the web run direction;

guiding the web through the press opening of the additional press; and providing a felt belt on each side of the web in the press opening of the first shoe press, and providing a single felt for each of the press opening of the second shoe press and the additional press, wherein the felts for the press opening of the second shoe press and for the additional press are arranged to contact opposite sides of the web.

2. A method for manufacturing a fibrous pulp web, comprising:

applying an increasing pressure to the web in a first press nip in which a maximum pressure in the first press nip is less than or equal to approximately 15 bar; and applying an increasing pressure to the web in a second press nip arranged downstream from the first press nip, relative to a web travel direction, in which a maximum pressure in the second press nip is approximately three times as large as the maximum pressure in the first press nip, and in which an initial pressure in the second press nip is less than a final pressure in the first press nip, wherein the first press nip is a double felted press nip and the second press nip is a single felted press nip.

3. The method in accordance with claim 2, further comprising applying increasing pressure to the web in a third press nip, wherein the third press nip is a single felted press nip, and the felt of the second press nip contacts an opposite surface of the web than the felt of the third press nip.

* * * * *